US006556106B1

(12) United States Patent
Sano et al.

(10) Patent No.: US 6,556,106 B1
(45) Date of Patent: Apr. 29, 2003

(54) DIELECTRIC FILTER

(75) Inventors: Kazuhisa Sano, Kawagoe (JP); Meiji Miyashita, Saitama-Ken (JP)

(73) Assignee: Toko, Inc., Tokyo (JP)

( * ) Notice: Subject to any disclaimer, the term of this patent is extended or adjusted under 35 U.S.C. 154(b) by 0 days.

(21) Appl. No.: 09/491,613

(22) Filed: Jan. 26, 2000

(30) Foreign Application Priority Data

Jan. 29, 1999 (JP) ..... 11-022002
Mar. 30, 1999 (JP) ..... 11-088220

(51) Int. Cl.[7] ..... H01P 1/20; H01P 7/04
(52) U.S. Cl. ..... 333/202; 333/206; 333/222
(58) Field of Search ..... 333/202, 206, 333/222

(56) References Cited

U.S. PATENT DOCUMENTS 5,499,004 A * 3/1996 Noguchi et al. ..... 333/202
5,737,696 A * 4/1998 Yorita ..... 333/202
5,929,726 A * 7/1999 Ito et al. ..... 333/206

FOREIGN PATENT DOCUMENTS

EP 0 525 416 A1 2/1993
EP 0 856 902 A2 8/1998
EP 0 859 423 A1 8/1998
JP 11-195905 7/1999
JP 11-225004 8/1999

* cited by examiner

*Primary Examiner*—Patricia Nguyen
(74) *Attorney, Agent, or Firm*—Cohen, Pontani, Lieberman & Pavane

(57) ABSTRACT

A small dielectric filter suitable for use in a high frequency band equal to or higher than 3 GHz. An input/output electrode made up of island type of conductive film is formed on one surface of the dielectric located on each end portion. In each of the dielectrics located on each end respectively, an earth electrode is formed on almost all of the remaining area of the one surface so as to be isolated from the input/output electrode and is also formed on all of the other surfaces with an exception of connecting surfaces. In an intermediate dielectric, an earth electrode is formed on all surfaces other than the connecting surface, and a conductive film connected to the earth electrode is formed on a part of at least one of the connecting surfaces of the dielectrics to be connected. Three or more elements of resonators may be integrally formed on a dielectric block, and, in that case, a through-hole is formed between the resonators.

2 Claims, 5 Drawing Sheets

DIELECTRIC FILTER

FIELD OF THE INVENTION

The present invention relates to a dielectric filter and in particular to a small dielectric filter suitable for use in a high frequency band equal to or higher than 3 GHz.

PRIOR ART

With the spread of mobile communication device, a frequency band higher than that in current operation is considered to be made use of. In the conventional mobile communication, the frequency band up to about 2 GHz is used, and a combination of dielectric coaxial resonators has been mainly employed as a filter used in the mobile station.

When the dielectric coaxial resonator is used, however, in the frequency band equal to or higher than 3 GHz, an axial dimension thereof has to be made shorter due to the frequency, which makes it extremely thinner and also makes it difficult to form an input and output coupling. In addition, to secure high Q, an outer diameter of the dielectric shall be made larger. For example, in order to secure a Q required at a frequency of 5 GHz, 10-odd mm of outer diameter is necessary. This goes against a requirement for making an electronic unit smaller and is not practical. Instead of coaxial TEM mode resonator, TE mode resonator may be considered to be used, which results in larger size of structure and requires a complex structure of input and output coupling.

SUMMARY OF THE INVENTION

The object of the present invention is to provide a dielectric filter, which provides sufficient filtering characteristic at high frequency band, for example, within the range of 3 GHz to 30 GHz, and meets the requirement for high Q, downsizing and thinner thickness.

The present invention solves the problems in the prior art described above by employing an entirely new structure quite different from conventional ones.

That is, the present invention provides a dielectric filter composed of three or more rectangular parallelepiped dielectrics connected in line, the dielectric filter characterized in that:

- an input/output electrode made up of island type of conductive film is formed on one surface of the dielectric located on each end portion;
- in each of the dielectrics located on each end respectively, an earth electrode is formed on almost all of the remaining area of the one surface so as to be isolated from the input/output electrode and is also formed on all of the other surfaces with an exception of connecting surfaces;
- in an intermediate dielectric, an earth electrode is formed on all surfaces other than the connecting surface; and
- a conductive film connected to the earth electrode is formed on a part of at least one of the connecting surfaces of the dielectrics to be connected.

Three or more elements of resonators may be integrally formed on a dielectric block, and, in that case, a through-hole is formed between the resonators.

Figure 1:
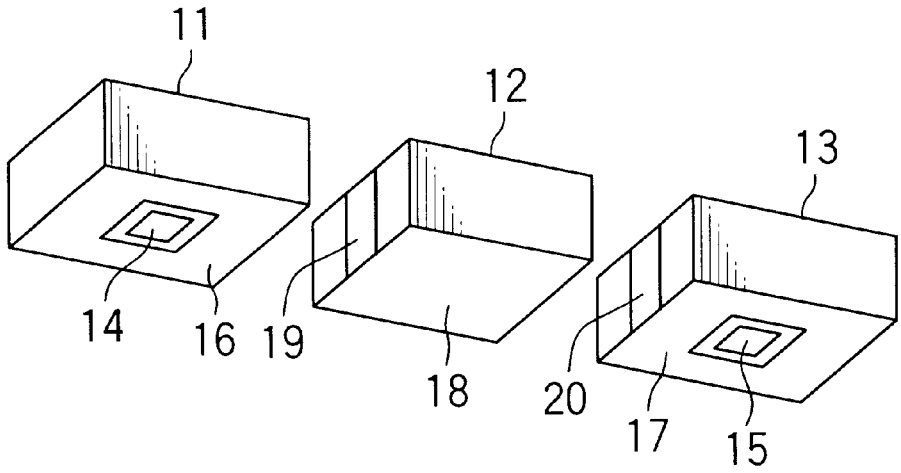
FIG. 1 is an exploded perspective view of an embodiment according to the present invention.

wherein, each of reference numerals 11, 12, 13, 51, 52 and 53 designates a dielectric; 31 designates a dielectric (block); each of 14, 15, 34, 35, 54 and 55 designates an input/output electrode; each of 16, 17, 18, 36, 56, 57 and 58 designates an earth conductor; each of 19, 20 and 59 designates a conductive strip; each of 39 and 40 designates a through hole; and 99 designates a slit.

DESCRIPTION OF THE PREFERRED EMBODIMENT

Though a resonance mode of a dielectric filter according to the present invention has not been completely analyzed, it is supposed that said dielectric filter operates just like a waveguide. It is supposed that an island type of electrode film formed on one surface of the dielectric is used as an input/output coupling structure and a coupling between the resonators is generated on a connecting surface or inside of the dielectric to make a filtering characteristic.

There will now be described a preferred embodiment of the present invention with reference to the attached drawings.

FIG. 1 is an exploded perspective view of an embodiment of the present invention illustrating a condition of a dielectric filter prior to being assembled. In this embodiment, three dielectric resonators are connected to make a unit. A rectangular parallelepiped dielectric 11, 13 with a dimension of $6.41\times6.0\times2.5$ $m^3$ and a dielectric constant of 37 is disposed on each end side respectively, and an island type of conductive film 14, 15 with a dimension of $1.4\times1.4$ $mm^2$is formed on a central portion of said $6.41\times6.0$ $mm^2$ surfaces respectively. A conductive film 16, 17 is formed surrounding said conductive film 14, 15 placing a distance of 0.5 mm therefrom, and a conductive film is also formed on all of other surfaces excepting a connecting surface to form an earth electrode by being connected to said conductive film 16, 17.

An intermediate dielectric resonator 12 has a dimension of $5.75\times6.0\times2.5$ $mm^3$ and a conductive film 18 is formed on all the surfaces thereof excepting connecting surfaces to form an earth electrode. In the connecting portions of the dielectrics 11, 12, 13, though the dielectrics are exposed, conductive strips 19, 20 are formed thereon extending from the surface on which the input/output electrode being formed to the opposite surface thereof to adjust a coupling between the resonators. In this embodiment, 2 mm width of conductive strip is formed on a central portion of the connecting surface. In each of the connecting portions between the dielectric resonators 11, 13 each being located on each end respectively and the intermediate dielectric resonator 12 connected thereto, said conductive strip may be formed on either of the connecting surfaces. In this embodiment, for example, said conductive strip may not be formed on the resonator 11, and may not be formed also on an invisible connecting surface of the resonator 12. Thus, the conductive film may be formed on at least one of the connecting surfaces.

Figure 2:
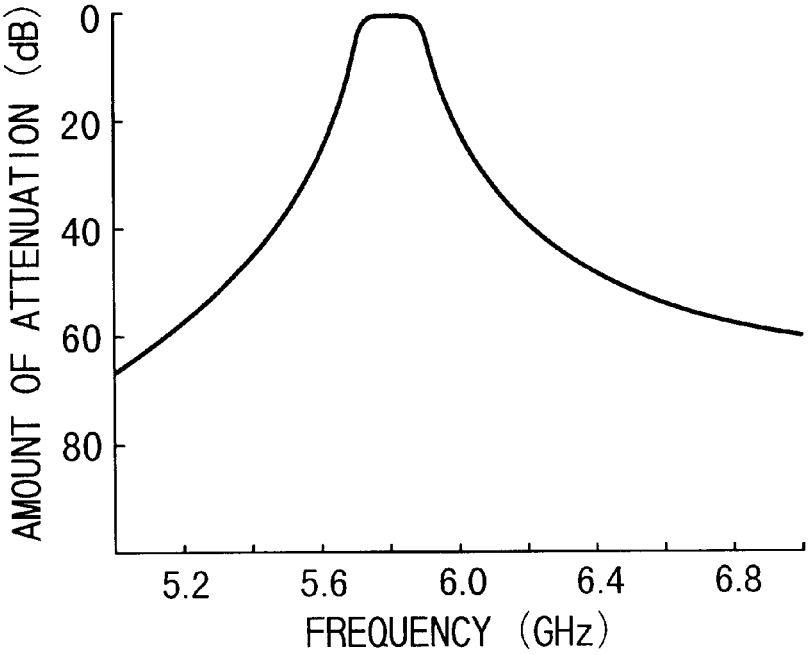
FIG. 2 is an explanatory diagram illustrating a characteristic of a dielectric filter according to the present invention.

FIG. 2 is an explanatory diagram illustrating a characteristic of the dielectric filter made up by connecting the dielectrics shown in FIG. 1. It is shown that the center frequency is in 5.81 GHz, 3 dB bandwidth is 184 MHz, and an insertion loss at a peak point is 0.77 dB.

Figure 3:
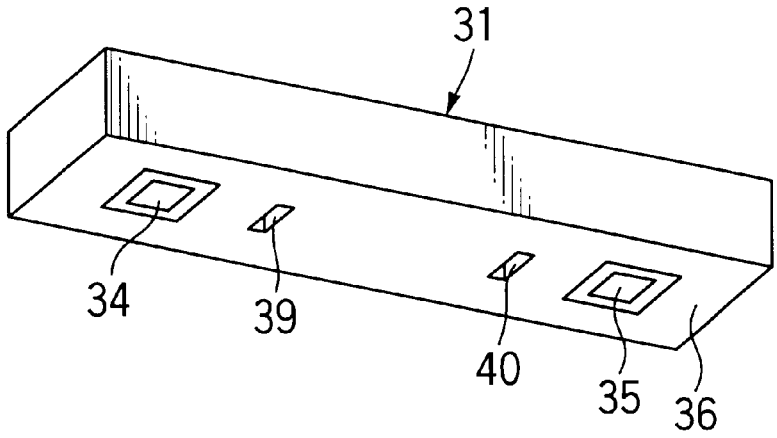
FIG. 3 is a perspective view of another embodiment according to the present invention.

FIG. 3 is a perspective view of another embodiment of the present invention, in which three dielectric resonators are integrally formed on one dielectric block. In this embodiment, the dielectric block 31 has a dimension of 19.22×6.00×2.50 $mm^3$ and a dielectric constant of 37, and each of input/output electrodes 34, 35 is formed on each end portion on a surface of 19.22×6.00 $mm^2$ respectively, and a dielectric resonator having no input/output electrode is disposed in a central portion, and each of through holes 39, 40 is formed between said input/output electrodes and said central dielectric resonator for adjusting the coupling between the resonators.

Each of the through holes 39 and 40 is formed by a size of 1.6×0.5 $m^2$at a location of 6.37 mm apart from a longitudinal end surface of the dielectric block 31 respectively. Thereby, the dimension of the central dielectric resonator is defined to be 5.48×6.00 $mm^2$. An input/output electrode 34, 35 having a dimension of 1.4×1.4 $mm^2$ is formed on the surface of the dielectric on each end portion, and a conductive film 36 is formed on almost of all remaining area of said surface surrounding said input/output electrodes 34, 35 placing 0.5 mm of distance therefrom and also on all of other surfaces to form an earth electrode.

Figure 4:
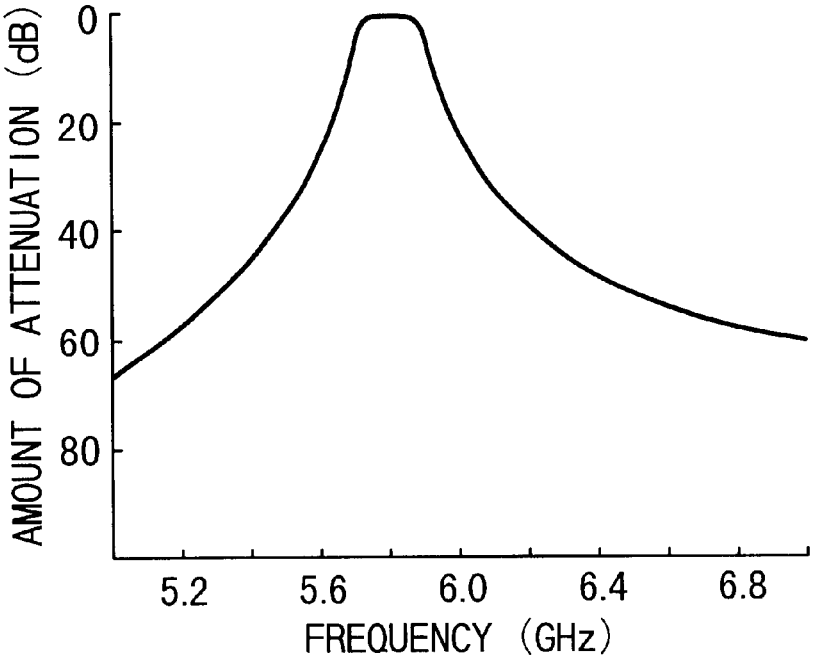
FIG. 4 is an explanatory diagram illustrating a characteristic of another dielectric filter according to the present invention.

FIG. 4 is an explanatory diagram illustrating a characteristic of the dielectric filter obtained from the dielectric block shown in FIG. 3. It is shown that the center frequency is in 5.80 GHz, 3 dB bandwidth is 163 MHz, and an insertion loss at a peak point is 0.82 dB.

Though, in the embodiment shown in FIG. 3, the coupling is adjusted by the through hole formed between the resonators, a groove formed on a side surface of the dielectric block may be also employed for adjusting the coupling. Additionally, in case of connection shown in FIG. 1, a conductive film may be formed on both sides instead of conductive strip to expose the dielectric on the central portions.

As shown in above embodiments, a dimension of the dielectric forming the resonator located on each end portion shall be different from that of the dielectric forming the resonator located on the central portion. This comes from the difference therebetween in an effective dielectric constant, and thereby the dimension of the dielectric located on each end portion shall be larger than that on the central portion.

Figure 5A:
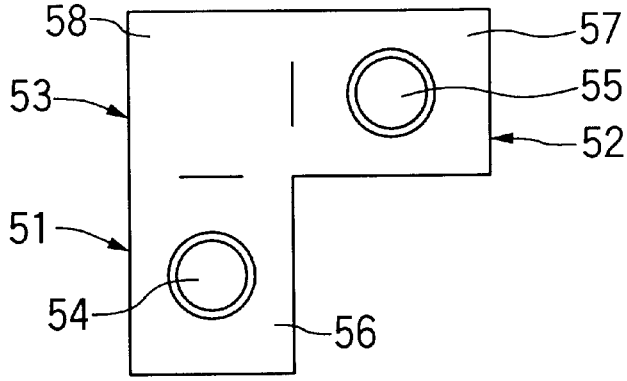
FIG. 5*a* is a plan view of another embodiment according to the present invention
Figure 5B:
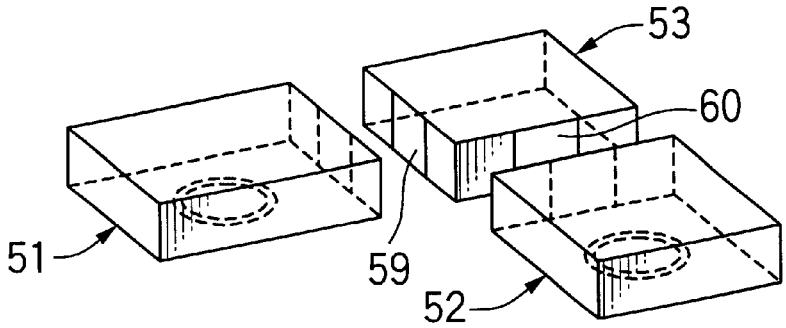
FIG. 5*b* is a perspective view of the embodiment shown in FIG. 5*a;*

An arrangement of the dielectric resonators is not limited to the example shown above, but another structure including a bend therein may be also employed. FIG. 5 shows another embodiment of the invention, in which FIG. 5*a* is a plan view and FIG. 5*b* is an exploded perspective view illustrating a condition of a dielectric filter prior to being assembled. In this embodiment, three dielectric resonators are connected to make a unit. A rectangular parallelepiped dielectric 51, 52 with a dimension of 11.8×10.0×3.0 $mm^3$ is disposed on each end side respectively, and a circular island type of conductive film 54, 55 with a diameter of 4 mm is formed thereon respectively. A conductive film 56, 57 is formed surrounding said island type conductive film 54, 55 placing a distance of 0.5 mm therefrom, and a conductive film is also formed on all of other surfaces excepting a connecting surface to form an earth electrode by being connected to said conductive film 56, 57.

An intermediate dielectric resonator 53 has a dimension of 10.0×10.0×3.0 $mm^3$ and a conductive film 58 is formed on all the surfaces thereof excepting connecting surfaces to form an earth electrode. The dielectric resonator 53 is connected using adjacent two end surfaces thereof to the dielectric resonators 51 and 52 respectively. In the connecting portions of the dielectrics 51, 52, 53, the dielectrics are exposed and conductive strips 59, 60 are formed thereon extending from the surface on which the input/output electrode is formed to the opposite surface thereof to adjust a coupling between the resonators. In this embodiment, 3.40 mm width of conductive strip is formed on a central portion of the connecting surface. In each of the connecting portions between the dielectric resonators 51, 52 each being located on each end respectively and the intermediate dielectric resonator 53 connected thereto, said conductive strip may be formed on either of the connecting surfaces of two resonators to be connected. In this embodiment, for example, said conductive strip may not be formed on the resonator 51, and may not be formed also on an invisible connecting surface of the resonator 52. Thus, the conductive film may be formed on at least one of the connecting surfaces.

Figure 6:
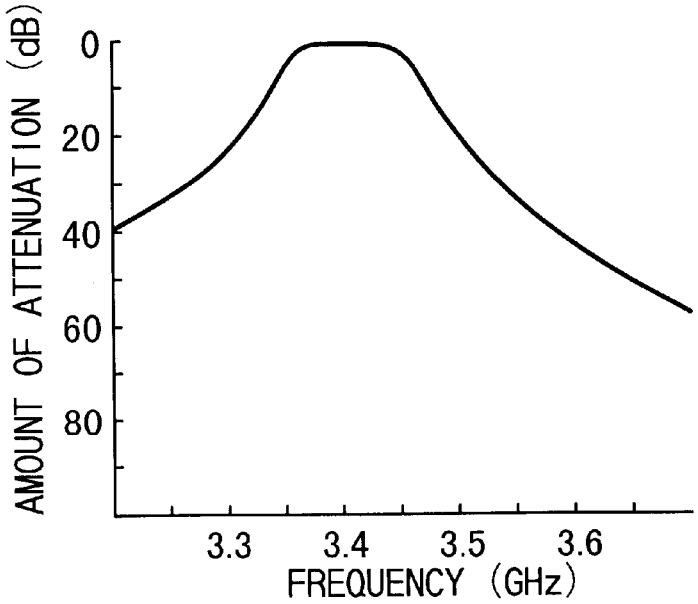
FIG. 6 is an explanatory diagram illustrating a characteristic of a dielectric filter shown in FIGS. 5*a* and 5*b* according to the present invention.

FIG. 6 is an explanatory diagram illustrating a characteristic of the dielectric filter made up by connecting the dielectrics shown in FIG. 5. It is shown that the center frequency is in 3.41 GHz, 3 dB bandwidth is 99.1 MHz, and an insertion loss at a peak point is 0.83 dB.

Figure 7A:
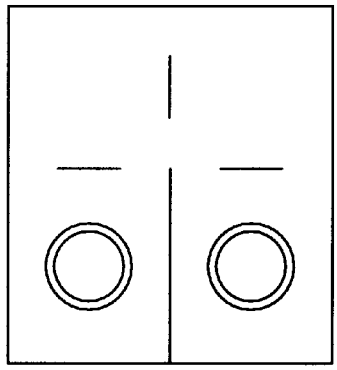
FIG. 7*a* is a plan view of another embodiment according to the present invention
Figure 7B:
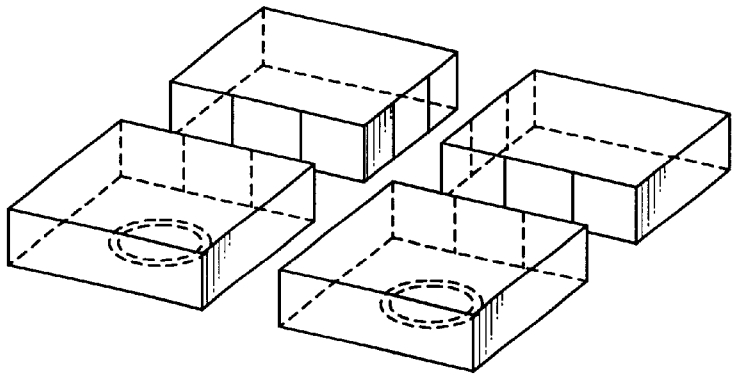
FIG. 7*b* is a perspective view of the embodiment shown in FIG. 7*a;*

FIG. 7 includes a plan view and a perspective view of another embodiment of the present invention, in which four dielectric resonators are connected so as for the dielectric resonators on respective input/output ends thereof to be disposed adjacently with each other. In this embodiment, the dielectric resonators on respective input/output ends thereof are formed to be a dimension of 11.2×10.0×3.0 $mm^3$ and two intermediate ones to be of 10.0×9.5 $mm^2$. As for the conductive films for adjusting the coupling, the conductive film between intermediate dielectric resonators is set to be as wide as 3.8 mm and that between the resonator on the input/output end and the intermediate resonator is set to be as wide as 3.4 mm.

Figure 8:
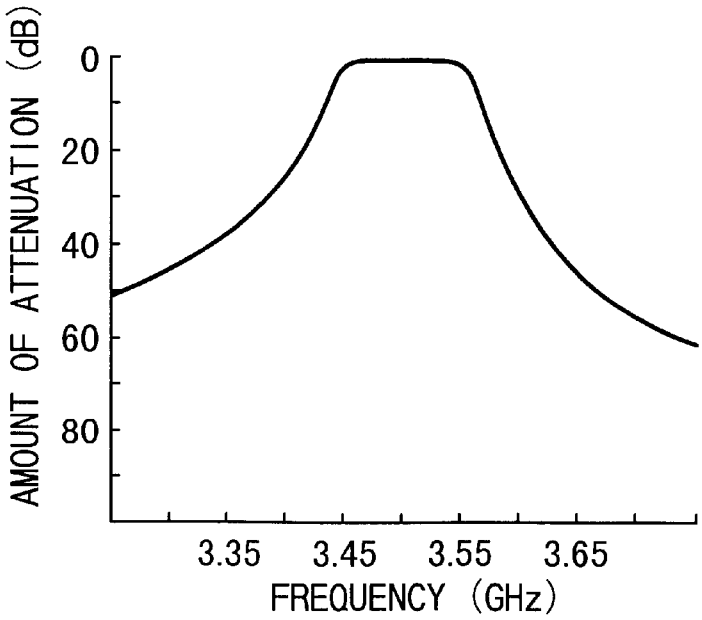
FIG. 8 is an explanatory diagram illustrating a characteristic of a dielectric filter shown in FIGS. 7*a* and 7*b* according to the present invention.

FIG. 8 is an explanatory diagram illustrating a characteristic of the dielectric filter made up by connecting the dielectrics shown in FIG. 7. It is shown that the center frequency is in 3.50 GHz, 3 dB bandwidth is 110.2 MHz, and an insertion loss at a peak point is 1.05 dB.

Figure 9:
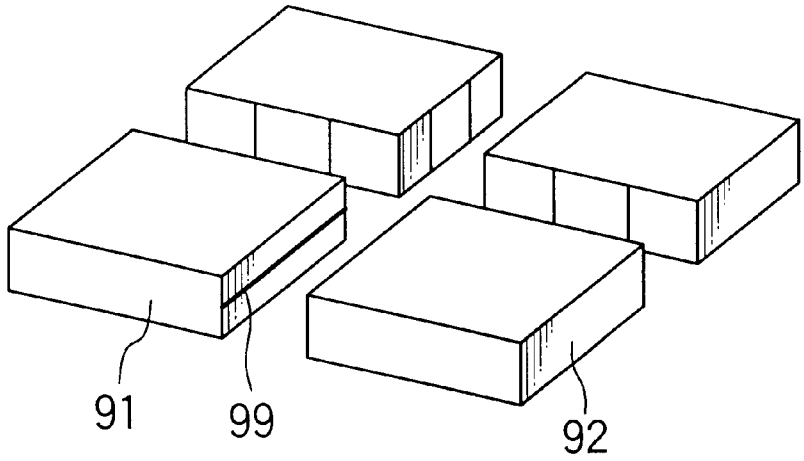
FIG. 9 is a perspective view of another embodiment according to the present invention.
Figure 10:
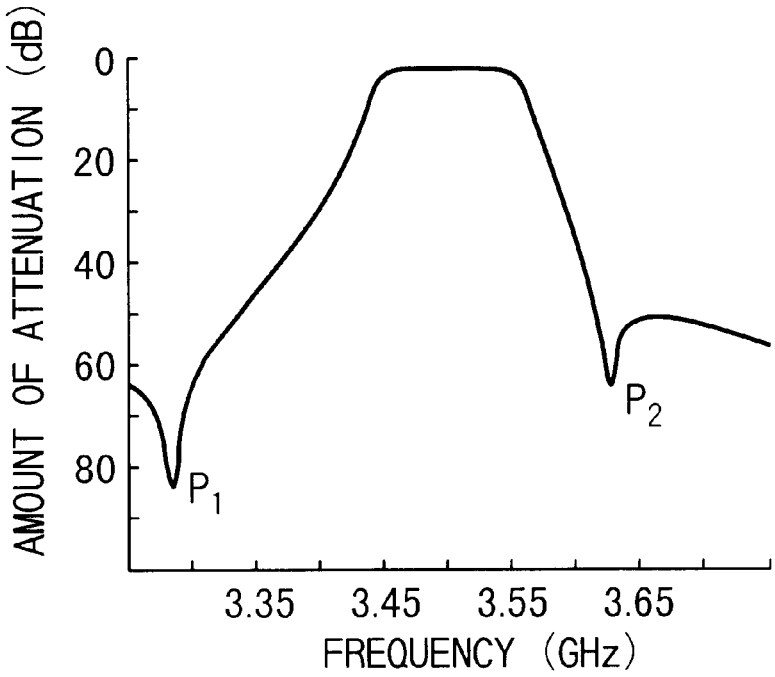
FIG. 10 is an explanatory diagram illustrating a characteristic of a dielectric filter shown in FIG. 9 according to the present invention.

In FIG. 9, four elements of dielectric resonators each having the same dimension as that shown in FIG. 7 are connected, in which resonators 91 and 92 located on input/output ends are brought into capacitive coupling. That is, a slit 99 exposing the dielectric is formed on the connecting surface of the resonators 91 and 92 each being located on the input/output ends respectively. The characteristic with the slit as wide as 0.005 mm is shown in FIG. 10. There is no change in the center frequency, 3 dB band width and the insertion loss, but extremes P1 and P2 of damping curve are formed on each side of pass band, which provides a steep damping characteristic.

Thus the dielectric resonators are brought into capacitive coupling by this slit 99 to provide polarity. When the structure in which the dielectric resonators are bent and connected is employed, the input and output ends are placed adjacently with each other, so that they may be connected without any additional element.

As shown in above embodiments, a dimension of the dielectric forming the resonator located on each end portion shall be different from that of the dielectric forming the resonator located on the central portion. This comes from the difference therebetween in an effective dielectric constant, and thereby the size of the dielectric located on each end portion shall be larger than that on the central portion. In above embodiment, the dielectric constant of each dielectric is 37.

According to the present invention, a small and thin dielectric filter capable of being used in a frequency band width equal to or more than 3 GHz may be provided. In addition, an easily producible and inexpensive dielectric filter may be provided since it can be made by merely forming a conductive film on a surface of the rectangular parallelepiped dielectric.

Further, the frequency of extreme may be arbitrarily set since the dielectric resonators located on the input/output end portions can be brought into capacitive coupling depending on the arrangement thereof and, in addition, the coupling condition thereof can be easily adjusted.

What is claimed is:

1. A dielectric filter composed of at least three rectangular parallelepiped dielectrics connected in line to form two end dielectrics and at least one intermediate dielectric, said dielectric filter characterized in that:

in each of the end dielectrics, respectively, an input/output electrode made up of island type of conductive film is formed on one surface thereof, and an earth electrode is formed on most of the remaining area of said one surface so as to be isolated from said input/output electrode and is also formed on all other surfaces of each of the end dielectrics with an exception of a connecting surface;

in each of the at least one intermediate dielectric, an earth electrode is formed on all surfaces other than connecting surfaces thereof;

a conductive film connected to the earth electrode is formed on a part of at least one of the connecting surfaces of the dielectrics to be connected; and wherein a longitudinal length of the end dielectrics is greater than that of the at least one intermediate dielectric.

2. A dielectric filter in accordance with claim 1, in which said conductive film connected to the earth electrode is a conductive strip for connecting the earth electrode on the surface on which the input/output electrode is formed to the earth electrode on the surface opposite thereto.

* * * * *